US005195474A

United States Patent [19]

Urata et al.

[11] Patent Number: 5,195,474

[45] Date of Patent: Mar. 23, 1993

[54] OIL SUPPLY SYSTEM IN INTERNAL CONBUSTION ENGINE

[75] Inventors: Yasuhiro Urata; Kazuhide Kumagai; Shigeru Suzuki, all of Saitama, Japan

[73] Assignee: Honda Giken Kogyo Kabushiki Kaisha, Tokyo, Japan

[21] Appl. No.: 850,613

[22] Filed: Mar. 13, 1992

[30] Foreign Application Priority Data

Mar. 15, 1991 [JP] Japan ..... 3-15489[U]

[51] Int. Cl.[5] ..... F01L 9/02; F01M 9/10

[52] U.S. Cl. ..... 123/90.12; 123/90.15; 123/90.33; 123/196 R; 123/196 M

[58] Field of Search ..... 123/90.12, 90.13, 90.15, 123/90.16, 90.17, 90.33, 90.34, 196 R, 196 M, 321

[56] References Cited

U.S. PATENT DOCUMENTS

| | | | |
|---|---|---|---|
| 4,392,463 | 7/1983 | Yasuhara | 123/196 M |
| 4,890,695 | 1/1990 | Morris et al. | 123/196 R |
| 4,942,855 | 7/1990 | Muto | 123/90.33 |
| 5,052,355 | 10/1991 | Ito et al. | 123/196 R |
| 5,085,181 | 2/1992 | Feuling | 123/90.12 |

FOREIGN PATENT DOCUMENTS

| | | | |
|---|---|---|---|
| 2605677 | 4/1988 | European Pat. Off. . | |
| 406527A1 | 1/1991 | European Pat. Off. . | |
| 316612 | 1/1917 | Fed. Rep. of Germany . | |
| 19028 | 2/1979 | Japan | 123/196 M |
| 245408 | 10/1990 | Japan | 123/90.17 |
| 910 | 1/1991 | Japan | 123/196 R |

*Primary Examiner*—E. Rollins Cross
*Assistant Examiner*—Weilun Lo
*Attorney, Agent, or Firm*—Lyon & Lyon

[57] ABSTRACT

In an internal combustion engine comprising a valve operating device which is disposed in a cylinder head coupled to an upper surface of a cylinder block and which includes a valve operating cam shaft connected to a crank shaft rotatably carried in a lower engine body portion including the cylinder block, and valve operation characteristic changing means for changing, in accordance with a variation in hydraulic pressure in a hydraulic pressure chamber, the operation characteristics of an engine valve which is supported in the cylinder head for opening and closing, a lower oil supply system and an upper oil supply system are disposed independently of each other. The lower oil supply system is comprised of a first oil pump connected to individual oil consumption parts disposed in a lower engine body portion for supplying a first oil, and the upper oil supply system is comprised of a second oil pump connected to individual oil consumption parts included in the valve operating device as well as to the hydraulic pressure chamber for supplying a second oil. This ensures that the second oil pump can be disposed in proximity to the hydraulic pressure chamber, so that an oil having a characteristic suitable for the operation of the valve operation characteristic changing means can be supplied quickly, and the cycle of replacement of the oil in the upper oil supply system can be prolonged.

4 Claims, 4 Drawing Sheets

OIL SUPPLY SYSTEM IN INTERNAL CONBUSTION ENGINE

BACKGROUND OF THE INVENTION

1. Field of the Invention

The invention generally relates to an oil supply system in an internal combustion engine comprising a valve operating device which is disposed in a cylinder head coupled to an upper surface of a cylinder block and which includes a valve operating cam shaft connected to a crank shaft rotatably carried in a lower engines body portion including the cylinder block, and valve operation characteristic changing means for changing, in accordance with a variation in hydraulic pressure in a hydraulic pressure chamber, the operation characteristic of an engine valve which is supported in the cylinder head for opening and closing.

2. Description of the Prior Art

Internal combustion engines including such a valve operating device are already known, for example, from Japanese Laid-open patent Application Nos. 229912/86 and 275516/86.

In such internal combustion engines, an oil pump for supplying a working oil to the hydraulic pressure chamber in the valve operation characteristic changing means is adapted to pump the working oil from an oil pan in a lower portion of an engine body. However, the oil pump is generally placed in the lower portion of the engine body and therefore, the distance between the oil pump and the hydraulic pressure chamber in valve operation characteristic changing means disposed in the cylinder heand, i.e., in an upper portion of the engine body is relatively long and hence, the supply of the oil to the hydraulic pressure chamber at the start of the engine is liable to be delayed.

Moreover, in general, an oil having a nature suitable for the lubrication of a crank shaft and a piston is used as an oil supplied from the oil pump. However, such oil has a large viscosity at a low temperature region, and the supply of an oil having a high viscosity to the hydraulic pressure chamber in the valve operation characteristic changing means in the valve operating device results in a non-smooth operation of the valve operation characteristic changing means and hence, the range of temperature for a normal operation of the valve operation characteristic changing means is limited. Thereupon, if an oil having a relatively low viscosity at a low temperature region is used, there is a fear of a seizure and a damage occurring in the crank shaft, the piston and the like.

In addition, in the lower portion of the engine body, the oil is exposed to blow-by gas and heated by heat of combustion and therefore, the deterioration of the oil progresses relatively rapidly. In contrast, in the upper portion of the engine body, there is no fear of contact of the oil with the blow-by gas, and the oil is less affected by heat of combustion, resulting in a relatively little increase in temperature of the oil. Nevertheless, if the same oil is used in the upper and lower portions of the engine body, it is necessary to replace all the oil at a relatively early cycle due to the deterioration of the nature of the oil due to the heating thereof in the lower portion of the engine body.

Accordingly, it is an object of the present invention to provide an oil supply system in an internal combustion engine, wherein the supply of an oil to the hydraulic pressure chamber at the start of the engine is conducted quickly, thereby providing an increase in range of temperature for the operation of the valve operation characteristic changing means, and also providing an improvement in life of the oil in the valve operating device.

SUMMARY OF THE INVENTION

To achieve the above object, according to the present invention, there is provided an oil supply system in an internal combustion engine comprising a valve operating device which is disposed in a cylinder head coupled to an upper surface of a cylinder block and which includes a valve operating cam shaft connected to a crank shaft rotatably carried in a lower engine body portion including the cylinder block, and valve operation characteristic changing means for changing, in accordance with a variation in hydraulic pressure in a hydraulic pressure chamber, the operation characteristic of an engine valve which is supported in the cylinder head for opening and closing, the oil supply system comprising a lower oil supply system comprised of a first oil pump connected to individual oil consumption parts disposed in the lower engine body portion for supplying a first oil, and an upper oil supply system comprised of a second oil pump connected to individual oil consumption parts included in the valve operating device as well as to the hydraulic pressure chamber for supplying a second oil, the lower and upper oil supply systems being disposed independently of each other. This ensures that the second oil pump can be disposed in proximity to the hydraulic pressure chamber, so that an oil having a characteristic suitable for the operation of the valve operations characteristic changing means can be supplied quickly, and the cycle of replacement of the oil in the upper oil supply system can be prolonged.

According to another aspect of the present invention, the second oil has a viscosity lower than that of the first oil at least at a low temperature. This ensures that the range of temperature for the operation of the valve operation characteristic changing means can be extended towarda lower temperature level.

According to a further aspect of the present invention, a variation rate in visocsity of the second oil with respect to the temperature is smaller than that of the first oil with respect to the temperature and therefore, the lubrication of the valve operating device at a high temperature can be conveniently carried out.

According to a yet further aspect of the present invention, the oil supply system further includes breather systems independent of each other for an upper engine body portion including the cylinder head, and the lower engine body portion. Therefore, the breathing can effectively be carried out, irrespective of independent provision of the upper and lower oil supply systems.

The above and other objects, features and advantages of the invention will become apparent from a consideration of the following description of the preferred embodiments, taken in conjunction wit the accompanying drawings.

DESCRIPTION OF THE PREFERRED EMBODIMENTS

The present invention will now be described by way of a preferred embodiment in connection with the accompanying drawings.

Figure 1:
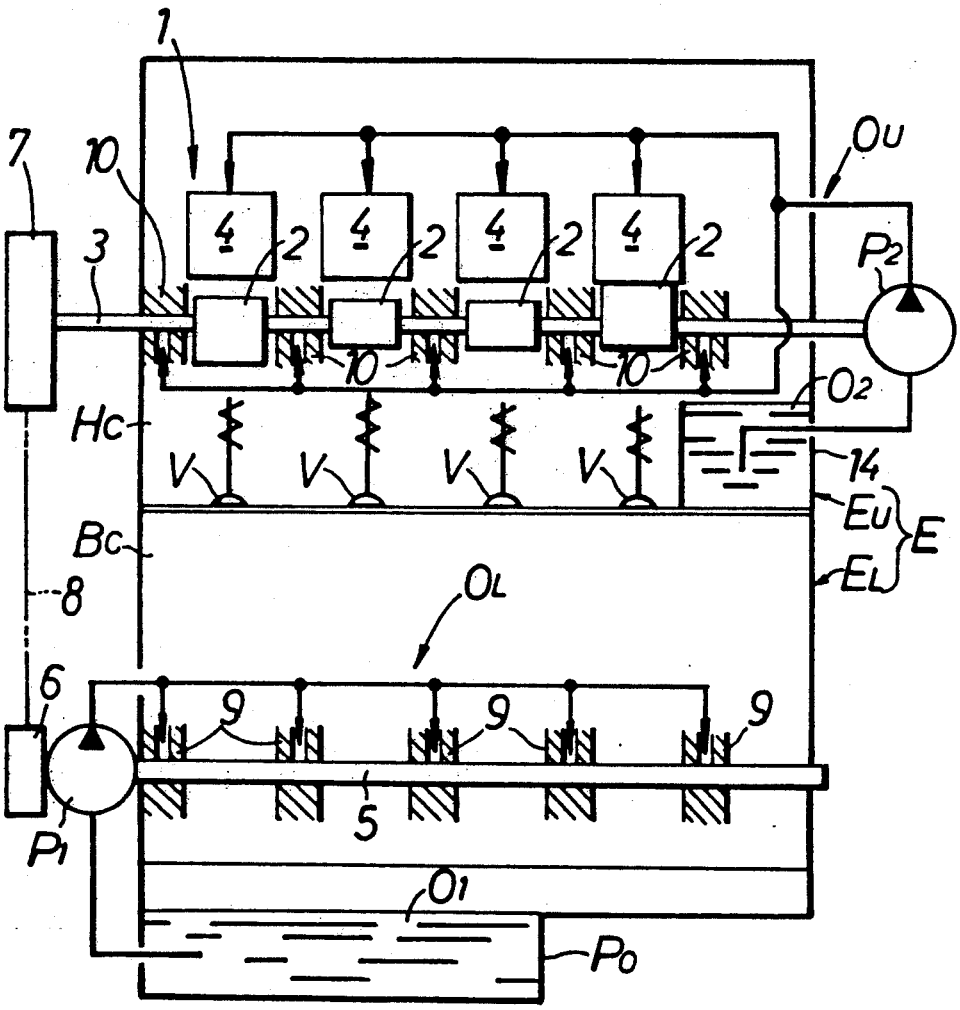
FIG. 1 is a schematic flow diagram of oil supply in an internal combustion engines.

Referring first to FIG. 1, an engine body E of a 4-cylinder internal combustion engine includes a lower engine body portion $E_L$ having an oil pan Po coupled to a lower portion of a cylinder block Bc, and an upper engine body portion $E_U$ having a cylinder head Hc coupled to an upper surface of the cylinder block Bc. A valve operating device 1 is disposed in the cylinder head Hc for driving an intake valve V as an engine valve disposed for every cylinder and an exhaust valve (not shown). The valve operating device 1 includes a valve operating cam shaft 3 having a cam 2 corresponding to each of the intake valves V for the cylinders as well as a cam (not shown) corresponding to each of the exhaust valves for the cylinders, and valve operation characteristic changing means 4 for the intake valve and valve operation characteristic changing means (not shown) for the exhaust valve, which are disposed for every cylinder to transmit a driving force from the valve operating cam shaft 3 to each of the intake valves and each of the exhaust valves through a hydraulic pressure. An endless transmitting belt 8 is wound around a driving pulley 6 mounted on a crank shaft 5 rotatably carried in the lower engine body portion $E_L$ and a follower pulley 7 mounted on the valve operating shaft 3, and a rotational power of the crank shaft 5 is transmitted at a reduction ratio of ½ to the valve operating cam shaft 3.

A lower oil : upply system $O_L$ on the side of the lower engine body portion $E_L$ and an upper oil supply system $O_U$ on the side of the upper engine body portion $E_u$ are disposed independently of each other in the engine body E. The lower oil sypply system $O_L$ is comprised of a first oil pump $P_1$ connected to individual oil consumption parts such as a plurality of crank journal portions 9 disposed in the lower engine body portion $E_L$ and cooling jets for cooling a sliding-contact surface of each of pistons (not shown) in the cylinders. The first oil pump $P_1$ is connected to the oil pan Po to pump a first oil. The upper oil supply system $O_U$ is comprised of a second oil pump $P_2$ connected to oil consumption parts such as a plurality of cam journal portions 10 included in the valve operating device 1 and sliding-contact surfaces of the cams 2, as well as to the valve operation characteristic changing means 4. The second oil pump $P_2$ is connected to an oil bath 14 mounted in the cylinder head Hc to pump a second oil. Moreover, the first oil pump $P_1$ is disposed in the cylinder block Bc and connected to the crankshaft 5. And the second oil pump $P_2$ is disposed in the cylinder head Hc and connected to the valve operating cam shaft 3.

Figure 2:
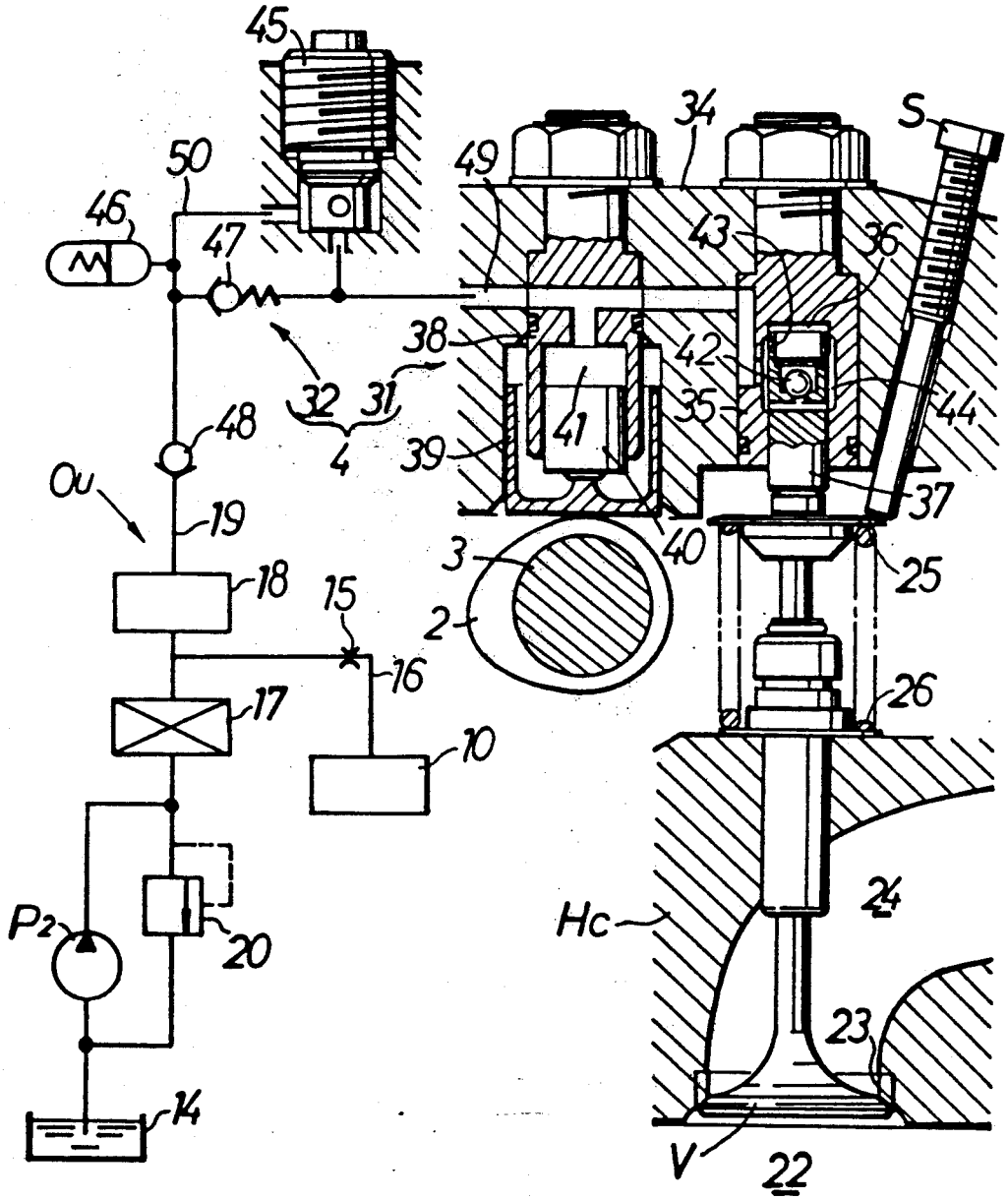
FIG. 2 is a partially longitudinal sectional view illustrating arrangements of an upper oil supply system and valve operation characteristic changing means.
Figure 3:
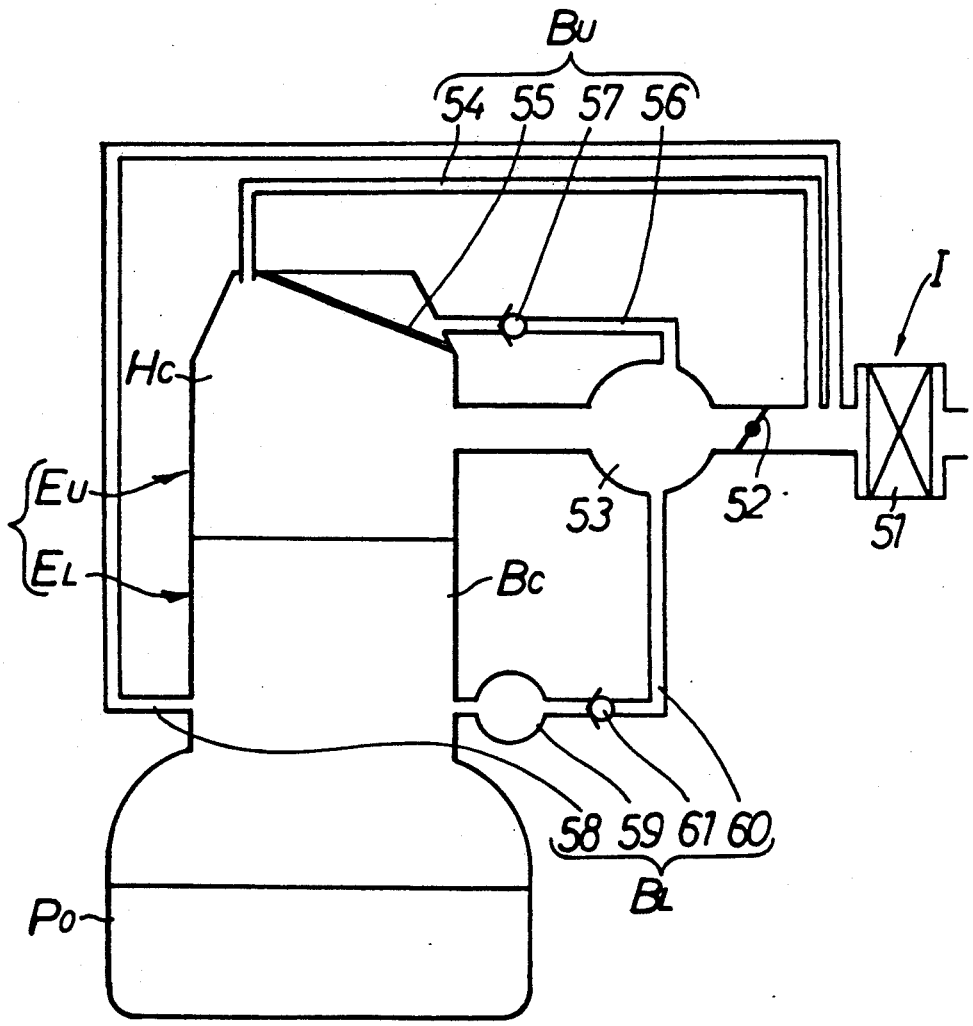
FIG. 3 is an illustration of breather systems.

Referring to FIG. 2, in the upper oil supply system $O_U$, an oil supply passage 19 including a filter 17 and a pressure control valve 18 is connected to a discharge port of the second oil pump $P_2$ which pumps a working oil from the oil bath 14, and a relief valve 20 is also connected to the discharge port. The oil supply passage 19 is connected to a hydraulic pressure chamber 41 in each of the valve operation characteristic changing means 4, and a branch passage 16, which diverges from a portion between the filter 17 and the pressure control valve 18 in the oil supply passage 19 and includes an orifice 15, is connected to the oil consumption parts such as the cam journal portions 10.

The cylinder head Hc has an intake valve bore 23 provided therein to lead to an intake port 24 and opened into a top of a combustion chamber 22 defined between the cylinder head Hc and the cylinder block Bc for every cylinder, and the intake valve V capable of opening and closing the intake valve bore 23 is vertically movably disposed in the cylinder head Hc. A collar 25 is provided at an upper end of the intake valve V, and a valve spring 26 is mounted in a compressed manner between the collar 25 and the cylinder head Hc. The intake valve V is biased upwardly, i.e., in a closing direction by a spring force of the valve spring 26.

Each of the valve operation characteristic changing means 4 is designed to transmit a driving force from the cam 2 of the valve operating cam shaft 3 rotatably disposed in an upper portion of the cylinder head Hc and to change the operation characteristic of the intake valve V as required by the engine, and is comprised of a transmitting mechanism 31 which is provided in a supporting block 34 fixed to the cylinder head Hc and which is interposed between the intake valve V and the cam 2, and a hydraulic circuit 32 also provided in the supporting block 34 and connected to the hydraulic pressure chamber 41 in the transmitting mechanism 31.

The transmitting mechanism 31 includes a first cylinder 35 fixed to the supporting block 34 coaxially with the intake valve V, a valve-driving piston 37 slidably received in a lower portion of the first cylinder 35 to abut against an upper end of the intake valve V and define a damper chamber 36 between the valve-driving piston 37 itself and the first cylinder 35, a second cylinder 38 fixed to the supporting block 34 above the cam 2, a lifter 39 slidably received in the supporting block 34 to come into sliding contact with the cam 2, and a cam follower piston 40 slidably received in a lower portion of the second cylinder 38 to abut against an upper end of the lifter 39 and define the hydraulic pressure chamber 41 between the cam follower piston 40 itself and the second cylinder 38.

The first cylinder 35 has an annular recess 44 provided in an inner surface thereof and normally communicating with the hydraulic pressure chamber 41. The annular recess 44 is formed to permit the hydraulic pressure chamber 41 to be put into communication with the damper chamber 36, when the intake valve V, i.e., the valve driving piston 37 is moved by a predetermined amount in an opening direction from its fully-closed position. Moreover, the valve driving piston 37 is provided with a check valve 42 for permitting only a flow of the working oil from the annular recess 44 leading to the hydraulic pressure chamber 41 into the damper chamber 36, and with an orifice 43 for permitting the communication of the annular recess 44 with the damper chamber 36.

Such transmitting mechanism 31 is in a state shown in FIG. 2, when the intake valve V is in its fully-closed state in which no hydraulic pressure in the hydraulic pressure chamber 41 is released. From this state, if the cam follower piston 490 is urged upwardly in response to the rotation of the cam 2, a hydraulic pressure developed in the hydraulic pressure chamber 41 is passed through the check valve 42 and the orifice 43 into the damper chamber 36, and the valve driving piston 37 is urged downwardly by such hydraulic pressure in the damper chamber 36. In the middle of downward sliding movement of the valve driving piston 37, the hydraulic pressure chamber 41 is put into direct communication with the damper chamber 36 through the annular recess 44, thereby increasing the amount of oil flowing into the damper chamber 36, and the valve driving piston 37 is urged further downwardly. This causes the intake valve V to be opened against the spring force of the valve spring 26.

If the urging force by the cam 2 is released after the intake valve V has been brought into its fully opened state, the intake valve V is driven upwardly, i.e., in the closing direction by the spring force of the valve spring 26. The valve driving piston 37 is also urged upwardly by the closing operation of the intake valve V, and the oil in the damper chamber 36 is returned into the hydraulic pressure chamber 41. When the direct communication between the annular recess 44 and the damper chamber 36 is released in the middle of the closing operation of the intake valve V, so that the orifice 43 is interposed between the damper chamber 36 and the annular recess 44, the amount of oil returned from the damper chamber 36 to the annular recess 44, i.e., the hydraulic pressure chamber 41 is limited. For this reasons, the speed of upward movement of the intake valve V, i.e., the valve closing speed is reduced from the middle of the valve-closing operation, and the intake valve V is slowly seated, thereby moderating the shock during seating.

A lift sensor S is disposed in the supporting block 34 for detecting the upper end of the intake valve V in its fully-closed state.

When the hydraulic pressure in the the hydraulic pressure chamber 41 in the transmitting mechanism 31 is released in the middle of the opening operation of the intake valve V, the hydraulic pressure chamber 41 loses a transmitting function enough to overcome the spring force of the valve spring 26 and to continue the opening of the intake valve V. Thus, the intake valve V starts closing by the resilient force of the valve spring 26 from the time of releasing of the hydraulic pressure and as a result, the volume of the hydraulic pressure chamber 41 is reduced.

The hydraulic circuit 32 serves to release the hydraulic pressure from the hydraulic pressure chamber 41 and supply the working oil to the hydraulic pressure chamber 41. The hydraulic circuit 32 is disposed in the supporting block 34 and includes a hydraulic pressure release valve 45, an accumulator 46, a one way valve 47 and a check valve 48.

The hydraulic pressure release valve 45 is a solenoid valve interposed between an oil passage 49 provided in the supporting block 34 to communicate with the hydraulic pressure chamber 41 and an oil passage 50 provided in the supporting block 34 to communicate with the accumulator 46. The one way valve 47 is disposed in the supporting block 34 between the oil passages 50 and 49 to bypass the hydraulic pressure release valve 45 and adapted to be opened to permit only a flow of the oil from the accumulator 46 toward the oil passage 49 and thus the hydraulic pressure chamber 41, when the hydraulic pressure in the oil passage 50 is larger than the hydraulic pressure in the oil passage 49 by a predetermined value or more. The check valve 48 is interposed between the oil supply passage 19 and an intermediate portion between the accumulator 46 and the one way valve 47, i.e., the oil passage 50 and is adapted to permit only a flow of the working oil from the oil supply passage 19 toward the oil passage 50.

When the hydraulic pressure in the hydraulic pressure chamber 41 is released by the hydraulic pressure releasing valve 45 in the middle of the opening operation of the intake valve V, the hydraulic pressure in the accumulator 46 is returned through the one way valve 47 to the hydraulic pressure chamber 41, and a deficiency is supplied through the check valve 48 to the hydraulic pressure valve 41, until the subsequent opening operation the intake valve V is started. It is required that the hydraulic pressure applied to the oil passage 50 through the check valve 48 is between a lower limit pressure which is a valve opening pressure for the one way valve 47 and an upper limit pressure which is a pressure in the accumulator 46 at the start of accumulation. The hydraulic pressure is controlled by the pressure control valve 18, so that it is within such range.

The need for a structure for permitting the oil to be dropped between the upper engine body $E_u$ and the lower engine body $E_L$ of the engine body E is eliminated by providing the upper oil supply system $O_U$ and the lower oil supply system $O_L$ independently of each other, as described above. Thus, breaker systems $B_U$ and $B_L$ are provided independently of each other for the upper and lower engine body portions $E_U$ and $E_L$. The breather system $B_U$ for the upper engine body portion $E_U$ is comprised of a communication pipe 54, a separator 55, a gas outlet pipe 56 and a one way valve 57 provided in the gas outlet pipe 56. The communication pipe 54 is provided to extent between a point between an air cleaner 51 and a throttle valve 52 in an intake system I connected to the engine body E, and an upper portion of the interior of the upper engine body portion $E_U$, and the separator 55 is disposed to divide the upper portion of the interior of the upper engine body portion $E_U$ at a location displaced from an opened end of the communication pipe 54. The gas outlet pipe 56 is provided to extend between an intake chamber 53 downstream from the throttle valve 52 in the intake system I and the upper portion of the interior of the upper engine body portion $E_U$ divided by the separator 55. The breather system $B_L$ for the lower engine body portion $E_L$ is comprised of a communication pipe 58, a separator 59, a gas outlet pipe 60 and a one way valve 61 provided in the gas outlet pipe 60. The communication pipe 58 is provided to extend between a point between the air cleaner 51 and the throttle valve 52 in the intake system I, and an upper portion of the interior of the lower engine body portion $E_L$, and the separator 59 has an expanded volume and communicates with the upper portion of the interior of the lower engine body portion E. The gas outlet pipe 60 is provided to extend between the intake chamber 53 in the intake system I and the separator 59.

Figure 4:
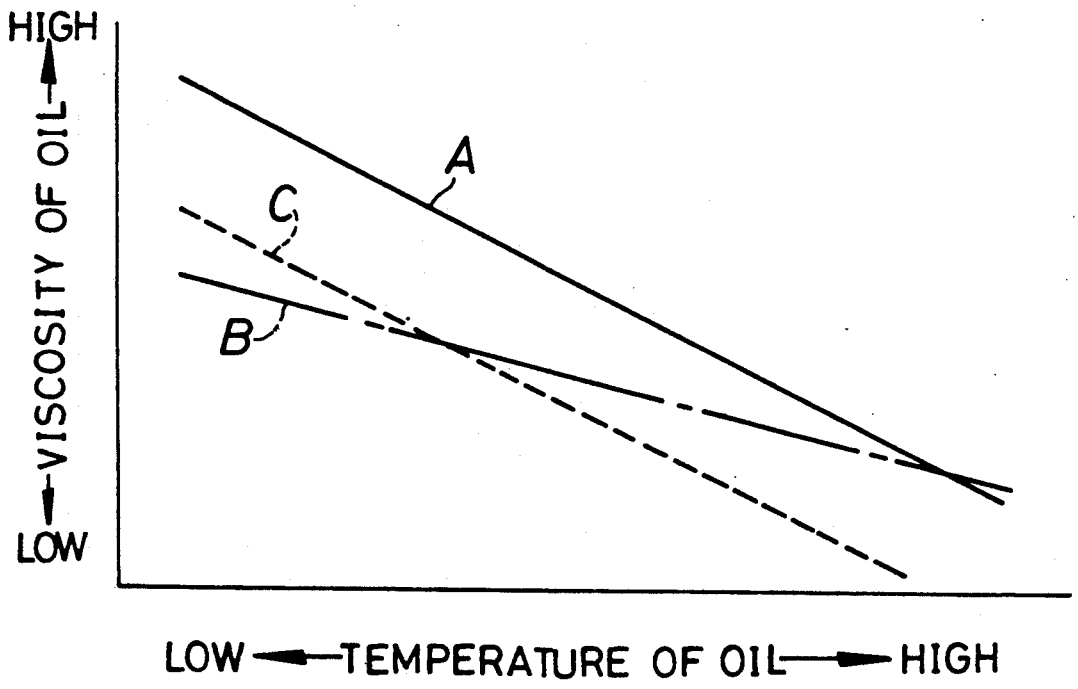
FIG. 4 is a graph illustrating variations is viscosity with respect to the temperature.

When the first oil used in the lower oil supply system $O_L$ has a variation in viscosity with respect to the temperature as shown by a straight line A in FIG. 4, a second oil lower in viscosity than the first oil at least at a lower temperature, as shown by straight lines B and C, is used in the upper oil supply system $O_U$. Desirably, a second oil having a variation rate in viscosity with respect to the temperature as shown by the straight line C is used.

An oil such as ULTRA-U (trade name) conventionally used as an engine oil is used as a first oil having a variation in viscosity an shown by the straight line A; an oil such as SILICONE-KF96 (trade name) is used as a second oil having a variation in viscosity as shown by the straight line B, and an oil such as R0-10 (trade name)

and FLUID-SPECIAL (trade name) is used as a second oil having a variation in viscosity as shown by the straight line C. The kinetic viscosity (cst) of such oils with respect to the temperature is as given in Table 1.

TABLE 1

| Type of oil | Temperature | | | |
|---|---|---|---|---|
| | −30° C. | 0° C. | 80° C. | 130° C. |
| First oil (straight line A): ULTRA-U (trade-name) | 8,000–10,000 | 550 | 17 | 6.0 |
| Second oil (straight line B): SILICONE-KF96 (trade name) | 200 | 80 | 20 | 12 |
| Second oil (straight line C): | | | | |
| RO-10 (trade name) | 300 | 44 | 4.0 | 2.0 |
| FLUID-SPECIAL (trade name) | 250 | 45 | 6.5 | — |

The operation of this embodiment will be described below. The second oil pump $P_2$ in the upper oil supply system $O_U$ is disposed in the cylinder head Hc to pump the working oil from the oil bath 14 provided in the cylinder head Hc, and the distance between the hydraulic pressure chamber 41 in the valve operation characteristic changing means 4 and the second oil pump $P_z$ can be reduced to a relative small value. Therefore, at the start of the engine, the supply of the oil to the hydraulic pressure chamber 41 in valve operation characteristic changing means 4 can be conducted quickly, leading to an improved responsiveness.

The first oil circulating through the lower oil supply system $O_L$ has a relatively high viscosity at a low temperature, as shown by the straight line A in FIG. 4, and has a nature suitable for the lubrication of the crank shaft 5 and the piston, thereby ensuring that a seizure and damage cannot occur in the crank shaft 5 and the piston.

The second oil circulating through the upper oil supply system $O_U$ has a relatively low viscosity at a low temperature, as shown by the straight lines B and C in FIG. 4, and the range of temperature for the normal operation of the valve operation characteristic changing means 4 can be extended toward a lower temperature level by independently providing the upper and lower oil supply systems $O_U$ and $O_L$. The use of an oil having a relatively small variation rate in viscosity with respect to the temperature as shown by the straight line B in FIG. 4 are a second oil is convenient for the lubrication of the cam journal portions 10 and the like, because of a smaller reduction in viscosity at a high temperature. However, even an oil having a low viscosity over the entire range of temperature as shown by the straight line C in FIG. 4 can be effecttively used for the lubrication of the cam journal portions 10 and the like, because the number of rotation of the valve operating cam shaft 3 is as relatively low as ½ of the number of rotations of the crank shaft 5.

in the lower oil supply system $O_L$, the first oil is brought into contact with blow-by gas and is heated by a heat of combustion and therefore, the deterioration of the nature of the first oil progresses relatively rapidly. In contrast, in the upper oil supply system $O_U$, there is no fear of contact of the first oil with the blow-by gas and the first oil is less affected by a heat of combustion and also, the increasse in temperature of the second oil is little, and therefore, the deterioration of the nature of the first oil progresses slowly. Thus, even if the second oil is relatively expense, it is possible to prolong the cycle of replacement of the second oil.

Attendant on the independent provision of the upper and lower oil supply systems $O_U$ and $O_L$, the breather system $B_U$ for the upper engine body portion $E_U$ and the breather system $B_L$ for the lower engine body portion $E_L$ are independent of each other and hence, the breathing from the engine body E can be effectively conducted.

Although the above embodiment has been described in connection with the intake valve used as an engine valve, it will be understood that the present invention can be carried out in connection with an exhaust valve used as an engine valve.

What is claimed is:

1. An oil supply system in an internal combustion engine comprising a valve operating device which is disposed in a cylinder head coupled to an upper surface of a cylinder block and which includes a valve operating cam shaft connected to a crank shaft rotatably carried in a lower engine body portion including the cylinder block, and valve operation characteristic changing means for changing, in accordance with a variation in hydraulic pressure in a hydraulic pressure chamber, the operation characteristics of an engine valve which is supported in the cylinder head for opening and closing, said oil supply system comprising a lower oil supply system comprised of a first oil pump connected to individual oil consumption parts disposed in the lower engine body portion for supplying a first oil, and an upper oil supply system comprised a second oil pump connected to individual oil consumption parts included in the valve operating device as well as to the hydraulic pressure chamber for supplying a second oil, said lower and upper oil supply systems being disposed independently of each other.

2. An oil supply system in an internal combustion engine according to claim 1, wherein said second oil has a viscosity lower than that of said first oil at least at a low temperature.

3. An oil supply system in an internal combustion engine according to claim 2, wherein a variation rate in viscosity of said second oil with respect to the temperature is smaller than that of said first oil with respect to the temperature.

4. An oil supply system in an internal combustion engine according to claim 1, further including breather systems independent of each other for an upper engine body portion including the cylinder head, and the lower engine body portion.

* * * * *